US008298357B2

(12) United States Patent
Sano et al.

(10) Patent No.: US 8,298,357 B2
(45) Date of Patent: Oct. 30, 2012

(54) HIGH-STRENGTH ALUMINUM ALLOY EXTRUDED PRODUCT EXHIBITING EXCELLENT CORROSION RESISTANCE AND METHOD OF MANUFACTURING SAME

(75) Inventors: Hideo Sano, Nagoya (JP); Yasuaki Yoshino, Kakamigahara (JP)

(73) Assignees: The Society of Japanese Aerospace Companies, Tokyo (JP); Sumitomo Light Metal Industries, Ltd., Tokyo (JP)

( * ) Notice: Subject to any disclaimer, the term of this patent is extended or adjusted under 35 U.S.C. 154(b) by 0 days.

(21) Appl. No.: 12/932,634

(22) Filed: Mar. 2, 2011

(65) Prior Publication Data

US 2011/0155291 A1 Jun. 30, 2011

Related U.S. Application Data

(62) Division of application No. 12/590,475, filed on Nov. 9, 2009, now Pat. No. 7,927,436, which is a division of application No. 10/550,801, filed as application No. PCT/JP2004/004767 on Apr. 1, 2004, now abandoned.

(30) Foreign Application Priority Data

Apr. 7, 2003 (JP) ..... 2003-103121

(51) Int. Cl.
*C22F 1/05* (2006.01)
*B21C 23/08* (2006.01)

(52) U.S. Cl. ..... 148/690; 72/264

(58) Field of Classification Search ..... 148/690, 148/689; 72/264, 265–269
See application file for complete search history.

(56) References Cited

FOREIGN PATENT DOCUMENTS

| | | |
|---|---|---|
| JP | 10-306338 | 11/1998 |
| JP | 2001-205329 | 7/2001 |
| JP | 2002-317255 | 10/2002 |

*Primary Examiner* — George Wyszomierski
*Assistant Examiner* — Janelle Morillo
(74) *Attorney, Agent, or Firm* — Flynn, Thiel, Boutell & Tanis, P.C.

(57) ABSTRACT

The present invention provides a high-strength aluminum alloy extruded product exhibiting excellent corrosion resistance and secondary workability and suitably used as a structural material for transportation equipment such as automobiles, railroad vehicles, and aircrafts, and a method of manufacturing the same. The aluminum alloy extruded product has a composition containing 0.6 to 1.2% of Si, 0.8 to 1.3% of Mg, and 1.3 to 2.1% of Cu while satisfying the following conditional expressions (1), (2), (3) and (4), $$3\% \leqq Si\ \% + Mg\ \% + Cu\ \% \leqq 4\% \quad (1)$$

$$Mg\ \% \leqq 1.7 \times Si\ \% \quad (2)$$

$$Mg\ \% + Si\ \% \leqq 2.7\% \quad (3)$$

$$Cu\ \%/2 \leqq Mg\ \% \leqq (Cu\ \%/2) + 0.6\% \quad (4)$$

and further containing 0.04 to 0.35% of Cr, and 0.05% or less of Mn as an impurity, with the balance being aluminum and unavoidable impurities. The cross section of the extruded product has a recrystallized structure with an average grain size of 500 μm or less.

4 Claims, 5 Drawing Sheets

HIGH-STRENGTH ALUMINUM ALLOY EXTRUDED PRODUCT EXHIBITING EXCELLENT CORROSION RESISTANCE AND METHOD OF MANUFACTURING SAME

This is a division of Ser. No. 12/590,475, filed Nov. 9, 2009 now U.S. Pat. No. 7,927,436, which is a division of Ser. No. 10/550,801, filed Mar. 16, 2006 now abandoned, which was the national stage of International Application No. PCT/JP2004/004767, filed Apr. 1, 2004, which International Application was not published in English.

TECHNICAL FIELD

The present invention relates to a high-strength aluminum alloy extruded product exhibiting excellent corrosion resistance. More particularly, the present invention relates to a method of manufacturing a high-strength aluminum alloy extruded product exhibiting excellent corrosion resistance and suitably used as a structural material for transportation equipment such as automobiles, railroad vehicles, and aircrafts.

BACKGROUND ART

A structural material for transportation equipment such as automobiles, railroad vehicles, and aircrafts is required to have performance such as (1) strength, (2) corrosion resistance, and (3) fracture mechanics properties (such as fatigue crack propagation resistance and fracture toughness). A recent material development trend involves overall evaluation including not only strength, but also production, assembly, and operation of the material.

As high-strength aluminum alloys, an Al—Cu—Mg aluminum alloy (2000 series) and an Al—Zn—Mg—Cu aluminum alloy (7000 series) have been known. These aluminum alloys exhibit excellent strength. However, these aluminum alloys do not necessarily exhibit sufficient corrosion resistance, and tend to produce cracks due to inferior extrudability. Therefore, since these aluminum alloys must be extruded at a low extrusion rate, manufacturing cost is increased. Moreover, it is difficult to extrude these aluminum alloys into a hollow product by using a porthole die or a spider die. Therefore, since it is necessary to form a desired structure by combining solid profiles, the application range of these aluminum alloys is limited.

A 6000 series (Al—Mg—Si) aluminum alloy, represented by an alloy 6061 and an alloy 6063, allows easy manufacture due to excellent workability, and exhibits excellent corrosion resistance. However, the 6000 series alloy exhibits insufficient strength in comparison with the 7000 series (Al—Zn—Mg) or 2000 series (Al—Cu) high-strength aluminum alloy. An alloy 6013, alloy 6056, alloy 6082, and the like have been developed as the 6000 series aluminum alloys provided with improved strength. However, these alloys do not necessarily exhibit strength and corrosion resistance sufficient to meet a demand for a reduction in the material thickness along with a reduction in the weight of vehicles.

In order to solve the above-described problems relating to the 6000 series aluminum alloys to obtain a high-strength aluminum alloy extruded product exhibiting excellent corrosion resistance, JP-A-10-306338 proposes an Al—Cu—Mg—Si alloy hollow extruded product containing 0.5 to 1.5% of Si, 0.9 to 1.6% of Mg, 1.2 to 2.5% of Cu while satisfying conditional expressions "3%≦Si %+Mg %+Cu %≦4%", "Mg %≦1.7×Si %", "Mg %+Si %≦2.7%", "2%≦Si %+Cu %≦3.5%", and "Cu %/2≦Mg %≦(Cu %/2)+0.6%", and further containing 0.02 to 0.4% of Cr and 0.05% or less of Mn as an impurity, with the balance being aluminum and unavoidable impurities, in which, when a tensile test is conducted for a weld joint inside a hollow cross section formed by extrusion in the direction perpendicular to the extrusion direction, the aluminum alloy extruded product breaks at a position other than the weld joint.

As an aluminum alloy extruded product of which the strength is improved by adding Mn to the above aluminum alloy extruded product and in which the corrosion resistance is maintained by controlling the thickness of the recrystallization layer of the extruded product, JP-A-2001-11559 proposes an aluminum alloy extruded product containing 0.5 to 1.5% of Si, 0.9 to 1.6% of Mn, 0.8 to 2.5% of Cu while satisfying conditional expressions "3%≦Si %+Mg %+Cu %≦4%", "Mg %≦1.7×Si %, Mg %+Si %≦2.7%", and "Cu %/2≦Mg %≦(Cu %/2)+0.6%", and containing 0.5 to 1.2% of Mn, with the balance being aluminum and unavoidable impurities, in which, when the minimum thickness of the extruded product is t (mm) and the extrusion ratio is R, the thickness G (μm) of the recrystallization layer on the surface of the extruded product satisfies "G≦0.326 t×R".

In the above aluminum alloy extruded product, the microstructure other than the recrystallization layer in the surface layer is made fibrous by adding Mn. Although the strength of this aluminum alloy extruded product is improved by this measure, a problem relating to extrudability, such as extrusion cracks, occurs depending on the conditions. Therefore, one of the inventors of the present invention, together with another inventor, proposed a method of improving extrudability by, when extruding a solid product by using a solid die, extruding a solid product under conditions where the bearing length of the solid die and the relationship between the bearing length and the thickness of the extruded product are specified, and, when extruding a hollow product by using a porthole die or a bridge die, extruding a hollow product under conditions where the ratio of the flow speed of the aluminum alloy in a non-joining section to the flow speed of the aluminum alloy in a joining section, in which the billet rejoins after entering a port section of the die in divided flows and subsequently encircling a mandrel, is controlled (JP-A-2002-319453).

These extruded products are generally used after being subjected to secondary working such as bending or machining after extrusion (primary working). However, since the above aluminum alloy extruded product containing Mn has a recrystallized structure in the surface layer and a fibrous structure inside the product, the surface properties and the dimensional accuracy after secondary working are decreased if the recrystallization texture becomes coarse. As a result, a severe dimensional tolerance may not be maintained or machinability may be decreased.

DISCLOSURE OF THE INVENTION

The inventors of the present invention conducted experiments and examinations in order to solve the above-described problems and to obtain a corrosion-resistant, high-strength aluminum alloy extruded product exhibiting further stable extrudability based on the proposed aluminum alloy composition and extrusion conditions. As a result, the inventors found that an aluminum alloy extruded product exhibiting excellent corrosion resistance and high strength, showing improved extrudability, and having a fine recrystallization texture over the entire cross section of the extruded product can be obtained by extruding an aluminum alloy containing specific amounts of Si, Mg, Cu, and Cr, in which the content of Mn as an impurity is limited, under the proposed extrusion conditions.

The present invention has been achieved based on this finding. An object of the present invention is to provide an aluminum alloy extruded product which satisfies the strength and corrosion resistance required for a structural material for transportation equipment such as automobiles, railroad vehicles, and aircrafts without reducing the productivity during extrusion and ensures excellent quality in secondary working such as bending or machining, and a method of manufacturing the same.

In order to achieve the above object, a first aspect of the present invention provides a high-strength aluminum alloy extruded product exhibiting excellent corrosion resistance, comprising an aluminum alloy which comprise, in mass %, 0.6 to 1.2% of Si, 0.8 to 1.3% of Mg, and 1.3 to 2.1% of Cu while satisfying the following conditional expressions (1), (2), (3), and (4), $$3\% \leqq Si\,\% + Mg\,\% + Cu\,\% \leqq 4\% \quad (1)$$

$$Mg\,\% \leqq 1.7 \times Si\,\% \quad (2)$$

$$Mg\,\% + Si\,\% \leqq 2.7\% \quad (3)$$

$$Cu\,\%/2 \leqq Mg\,\% \leqq (Cu\,\%/2) + 0.6\% \quad (4)$$

and further comprises 0.04 to 0.35% of Cr, and 0.05% or less of Mn as an impurity, with the balance being aluminum and unavoidable impurities, the aluminum alloy extruded product having a recrystallization texture with a grain size of 500 μm or less.

A second aspect of the present invention provides the high-strength aluminum alloy extruded product exhibiting excellent corrosion resistance, wherein the aluminum alloy further comprises at least one of 0.03 to 0.2% of Zr, 0.03 to 0.2% of V, and 0.03 to 2.0% of Zn.

A third aspect of the present invention provides a method of manufacturing a high-strength aluminum alloy extruded product exhibiting excellent corrosion resistance, the method comprising: extruding a billet of the aluminum alloy into a solid product by using a solid die, in which a bearing length (L) is 0.5 mm or more and the bearing length (L) and a thickness (T) of the solid product to be extruded have a relationship expressed as "L≦5T", to obtain an extruded solid product of which a cross-sectional structure has a recrystallized structure with a grain size of 500 μm or less.

A fourth aspect of the present invention provides the method of manufacturing a high-strength aluminum alloy extruded product exhibiting excellent corrosion resistance, wherein a flow guide is provided at a front of the solid die, an inner circumferential surface of a guide hole in the flow guide being apart from an outer circumferential surface of an orifice which is continuous with the bearing of the solid die at a distance of 5 mm or more, and the flow guide having a thickness 5 to 25% of a diameter of the billet.

A fifth aspect of the present invention provides a method of manufacturing a high-strength aluminum alloy extruded product exhibiting excellent corrosion resistance, the method comprising: extruding a billet of the aluminum alloy into a hollow product by using a porthole die or a bridge die while setting a ratio of a flow speed of the aluminum alloy in a non-joining section to a flow speed of the aluminum alloy in a joining section in a weld chamber, where the billet reunites after entering a port section of the die in divided flows and subsequently encircling a mandrel, at 1.5 or less, to obtain a hollow extruded product of which a cross-sectional structure has a recrystallized structure with a grain size of 500 μm or less.

A sixth aspect of the present invention provides the method of manufacturing a high-strength aluminum alloy extruded product exhibiting excellent corrosion resistance, the method comprising: homogenizing the billet of the aluminum alloy at a temperature equal to or higher than 500° C. and lower than a melting point of the aluminum alloy; and heating the homogenized billet to a temperature equal to or higher than 470° C. and lower than the melting point of the aluminum alloy and extruding the billet.

A seventh aspect of the present invention provides the method of manufacturing a high-strength aluminum alloy extruded product exhibiting excellent corrosion resistance, the method comprising: a quenching step of maintaining a surface temperature of the extruded product immediately after extrusion at 450° C. or higher and then cooling the extruded product to 100° C. or lower at a cooling rate of 10° C./sec or more, or subjecting the extruded product to a solution heat treatment at a temperature of 480 to 580° C. at a temperature rise rate of 5° C./sec or more and then a quenching step of cooling the extruded product to 100° C. or lower at a cooling rate of 10° C./sec or more; and a tempering step of heating the extruded product at 170 to 200° C. for 2 to 24 hours.

BEST MODE FOR CARRYING OUT THE INVENTION

Figure 1:
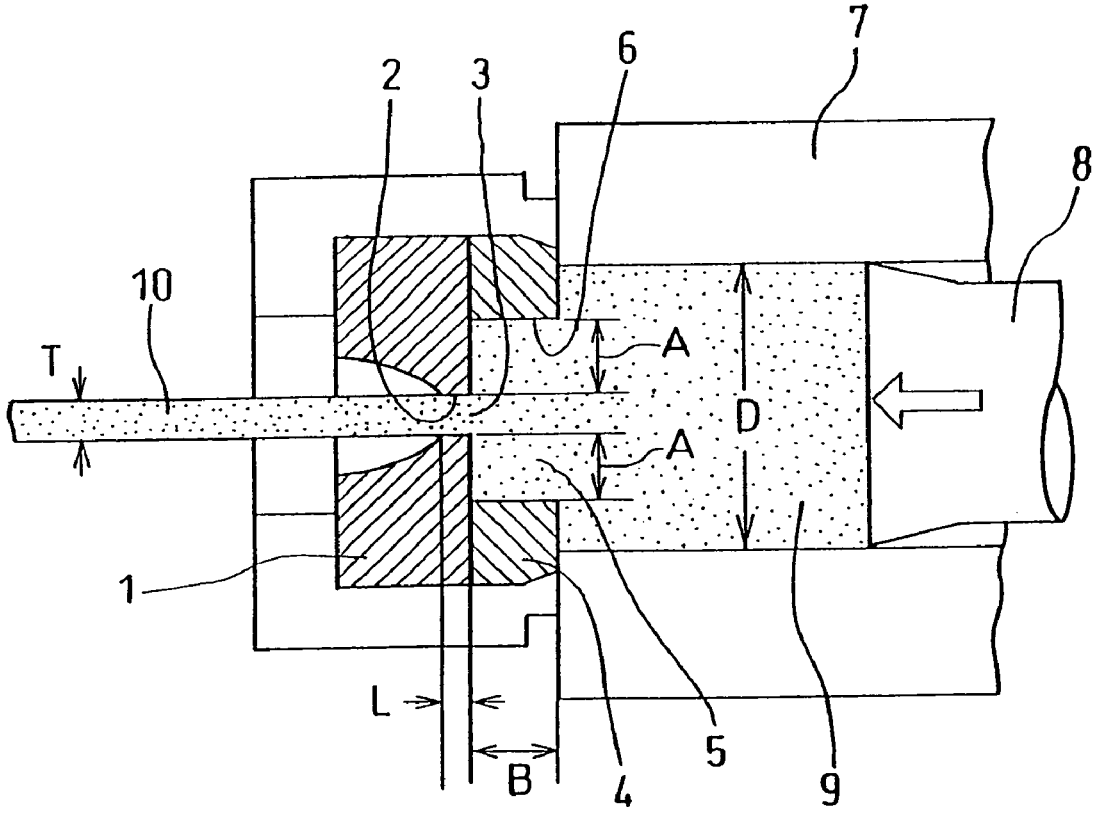
FIG. 1 is a cross-sectional view showing a solid die and a flow guide used in the present invention.

Effects and reasons for the limitations of the alloy components of the aluminum alloy of the present invention are described below.

Si forms a fine intermetallic compound ($Mg_2Si$) together with Mg to increase the strength of the aluminum alloy. The Si content is preferably 0.6 to 1.2%. If the Si content is less than 0.6%, the effect may be insufficient. If the Si content exceeds 1.2%, corrosion resistance may be decreased. The Si content is still more preferably 0.7 to 1.0%.

Mg forms $Mg_2Si$ together with Si and forms $CuMgAl_2$ together with Cu to increase the strength of the aluminum alloy. The Mg content is preferably 0.8 to 1.3%. If the Mg content is less than 0.8%, the effect may be insufficient. If the Mg content exceeds 1.3%, corrosion resistance may be decreased. The Mg content is still more preferably 0.9 to 1.2%.

Cu improves the strength of the aluminum alloy in the same manner as Si and Mg. The Cu content is preferably 1.3 to 2.1%. If the Cu content is less than 1.3%, the effect may be insufficient. If the Cu content exceeds 2.1%, corrosion resistance may be decreased. And also, the deformation resistance is increased during extrusion so that jamming occurs when manufacturing a hollow extruded product. The Cu content is still more preferably 1.5 to 2.0%.

Cr refines the microstructure of the alloy to improve formability, and increases corrosion resistance. The Cr content is preferably 0.04 to 0.35%. If the Cr content is less than 0.04%, the effect may be insufficient so that corrosion resistance is decreased. If the Cr content exceeds 0.35%, a coarse intermetallic compound tends to be formed so that recrystallized grains become nonuniform, whereby formability may be decreased. The Cr content is still more preferably 0.1 to 0.2%.

Mn refines the grain size to improve strength. However, Mn forms an Mn-based intermetallic compound so that corrosion is accelerated due to pitting corrosion occurring at the Mn-based compound. Therefore, it is important to limit the Mn content to preferably 0.05% or less, more preferably 0.02% or less, and still more preferably 0.01% or less.

The aluminum alloy of the present invention includes Si, Mg, Cu, and Cr as essential components, in which the content of Si, Mg, and Cu must satisfy the conditional expressions (1) to (4). This ensures that a preferable dispersion state of intermetallic compounds is obtained, whereby the aluminum alloy exhibits excellent strength, corrosion resistance, and formability. If the total content of Si, Mg, and Cu is less than 3%, a desired strength may not be obtained. If the total content of Si, Mg, and Cu exceeds 4%, corrosion resistance may be decreased. If the quantitative relationship between Mg and Si satisfies "Mg %≦1.7×Si %" and "Mg %+Si %≦2.7%" and the quantitative relationship between Mg and Cu satisfies "Cu %/2≦Mg≦(Cu %/2)+0.6%", the amount and the distribution state of intermetallic compounds are controlled so that the alloy is provided with well-balanced strength, formability, and corrosion resistance.

Zr, V, and Zn, which may be added to the aluminum alloy of the present invention as optional components, form intermetallic compounds to reduce the grain size, and increase the strength. If the content of Zr, V, and Zn is less than the lower limit, the effect may be insufficient. If the content of Zr, V, and Zn exceeds the upper limit, a large amount of coarse intermetallic compound may be formed, whereby formability and corrosion resistance may be decreased. The features of the present invention are not impaired if the aluminum alloy of the present invention contains a small amount of Ti and B, which are generally added to refine the ingot structure.

A preferred method of manufacturing an aluminum alloy extruded product of the present invention is described below. A molten aluminum alloy having the above-described composition is cast into a billet by semicontinuous casting, for example. The resulting billet is homogenized at a temperature equal to or higher than 500° C. and lower than the melting point of the aluminum alloy. If the homogenization temperature is lower than 500° C., segregation of the ingot is not sufficiently eliminated so that formation of $Mg_2Si$ and dissolution of Cu, which increase the strength, become insufficient, whereby a sufficient strength and elongation cannot be obtained.

After homogenization, the billet is heated to a temperature equal to or higher than 470° C. and lower than the melting point of the aluminum alloy, and then hot-extruded. The combination of the extrusion temperature and the extrusion rate is adjusted in order to obtain a fine recrystallization texture with a grain size of 500 μm or less. If the extrusion temperature is lower than 470° C., the elements added are not sufficiently dissolved, whereby the strength is decreased.

When press-quenching the extruded product, the surface temperature of the extruded product immediately after extrusion is maintained at 450° C. or higher, and cooled to a temperature equal to or lower than 100° C. at a cooling rate of 10° C./sec or more. In the press-quenching step, if the surface temperature of the extruded product is lower than 450° C., a quenching delay may occur in which the solute components precipitate, whereby a desired strength cannot be obtained. If the cooling rate is less than 10° C./sec, compounds precipitate in an undesirable dispersion state so that corrosion resistance, strength, and elongation become insufficient. The cooling rate is still more preferably 50° C./sec or more.

The extruded product may be subjected to a solution heat treatment at a temperature of 480 to 580° C. at a temperature rise rate of 5° C./sec or more in a heat treatment furnace such as a controlled atmosphere furnace or a salt bath furnace, and cooled to a temperature equal to or lower than 100° C. at a cooling rate of 10° C./sec or more according to a general quenching procedure. If the solution heat treatment temperature is lower than 480° C., dissolution of precipitates may become insufficient, whereby a sufficient strength and elongation cannot be obtained. If the solution heat treatment temperature exceeds 580° C., elongation is decreased due to local eutectic melting. If the cooling rate during quenching is less than 10° C./sec, compounds precipitate in an undesirable dispersion state in the same manner as in the press-quenching step so that corrosion resistance, strength, and elongation become insufficient. The cooling rate is still more preferably 50° C./sec or more.

The extruded product subjected to quenching exhibits excellent elongation after natural aging (T4 temper). However, it is preferable to perform tension leveling after quenching by subjecting the extruded product to tempering at 170 to 200° C. for 2 to 24 hours. If the tempering temperature is lower than 170° C., tempering must be performed for a long time in order to obtain a desired strength, thereby making it undesirable from the viewpoint of industrial productivity. If the tempering temperature exceeds 200° C., the strength is decreased. If the heat treatment time is less than two hours, a sufficient strength cannot be obtained. If the heat treatment time exceeds 24 hours, the strength is decreased.

A specific embodiment of the extrusion method according to the present invention is described below. In the extrusion method according to the present invention, a solid product is extruded as described below. An aluminum alloy having a specific composition is cast into a billet by semicontinuous casting, and hot-extruded into a solid product by using a solid die. FIG. 1 shows a device configuration when extruding a solid product by using a solid die. When manufacturing a long extruded product, a flow guide 4 is provided at the front of a solid die 1 in order to enable continuous extrusion of billets.

An aluminum alloy billet 9 placed in an extrusion container 7 is pushed by an extrusion stem 8 in the direction indicated by the arrow and enters a guide hole 5 in the flow guide 4. The aluminum alloy billet 9 then enters an orifice 3 in the solid die 1, is formed by a bearing face 2 of the solid die 1, and is extruded into a solid product 10.

Figure 2:
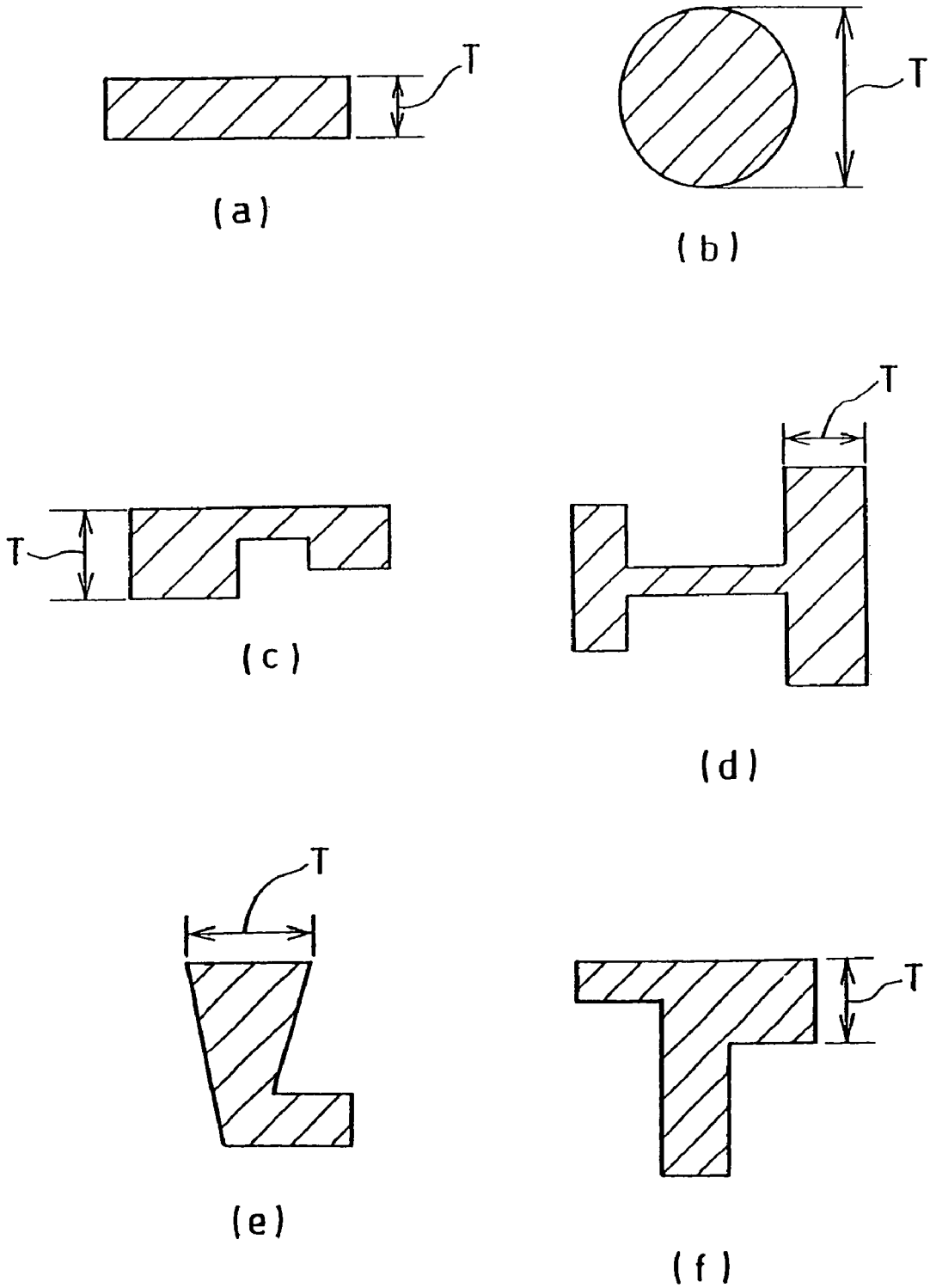
FIG. 2 is a view showing a thickness T of a solid extruded product of the present invention.

When extruding a solid product, the shape of the extruded product is determined by the bearing face of the solid die, and the bearing length L affects the properties of the extruded product. In the present invention, it is essential that the bearing length L be 0.5 mm or more (0.5 mm≦L), and the relationship between the bearing length L and the thickness T (see FIG. 2) of the solid extruded product 10 in the cross section perpendicular to the extrusion direction be "L≦5T", and preferably "L≦3T". A solid extruded product having a recrystallization texture with a grain size of 500 μm or less in the cross-sectional structure of the solid extruded product can be manufactured by extrusion using a solid die having the above-mentioned dimensions. A solid extruded product having a recrystallization texture with a grain size of 500 μm or less in the cross-sectional structure exhibits excellent strength, corrosion resistance, and secondary workability. The thickness T refers to the maximum thickness of a solid extruded product in the cross section perpendicular to the extrusion direction, as shown in FIG. 2.

If the bearing length is less than 0.5 mm, since it becomes difficult to process the bearing, the bearing may undergo elastic deformation so that the dimensions tend to become unstable. If the bearing length exceeds 5T, the grain size of the cross-sectional structure of the solid extruded product is increased.

When providing the flow guide 4 at the front of the solid die 1, it is essential that an inner circumferential surface 6 of the guide hole 5 in the flow guide 4 be apart from the outer circumferential surface of the orifice 3 in the solid die 1 at a distance of 5 mm or more (A≦5 mm), and the thickness B of the flow guide 4 be 5 to 25% of the diameter of the billet 9 (B=D×5-25%). Applying such a flow guide in combination with a solid die having the above-described bearing dimensions ensures that the cross-sectional structure of the resulting solid extruded product has a recrystallized structure with a grain size of 500 μm or less so that a solid extruded product exhibiting excellent strength, corrosion resistance, and secondary workability is obtained.

If the distance A between the inner circumferential surface 6 of the guide hole 5 in the flow guide 4 and the outer circumferential surface of the orifice 3 in the solid die 1 is less than 5 mm, the degree of working of the billet is increased in the guide hole 5, whereby the grain size of the resulting solid extruded product is increased. If the length B of the flow guide 4 is less than 5% of the diameter D of the billet 9, the flow guide 5 exhibits an insufficient strength and tends to be deformed. If the length B of the flow guide 4 is greater than 25% of the diameter D of the billet 9, the degree of working of the billet is increased in the guide hole 5 so that cracks occur in the resulting solid extruded product, whereby the strength and elongation are decreased to a large extent. When forming a quadrilateral solid extruded product, occurrence of cracks at the corners can be prevented by rounding off the corners with a radius of 0.5 mm or more.

Figure 3:
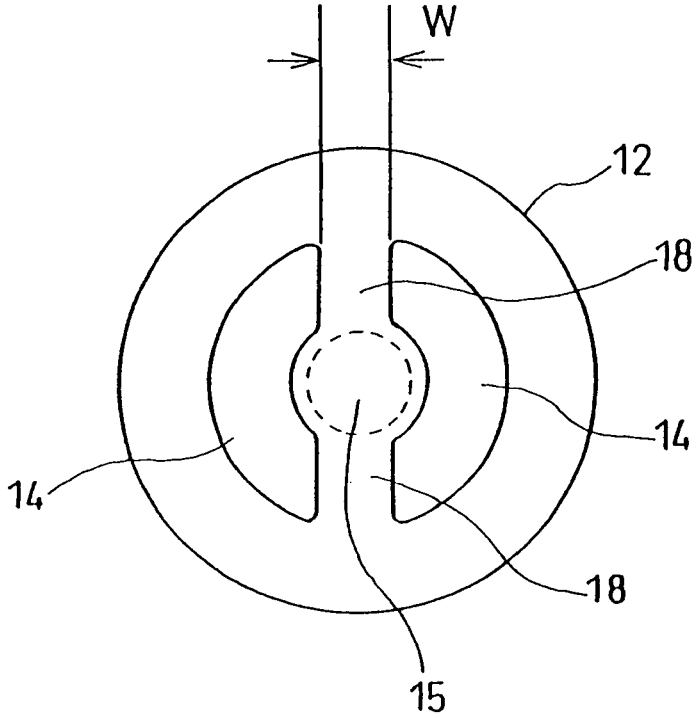
FIG. 3 is a front view showing a male die of a porthole die used in the present invention.
Figure 4:
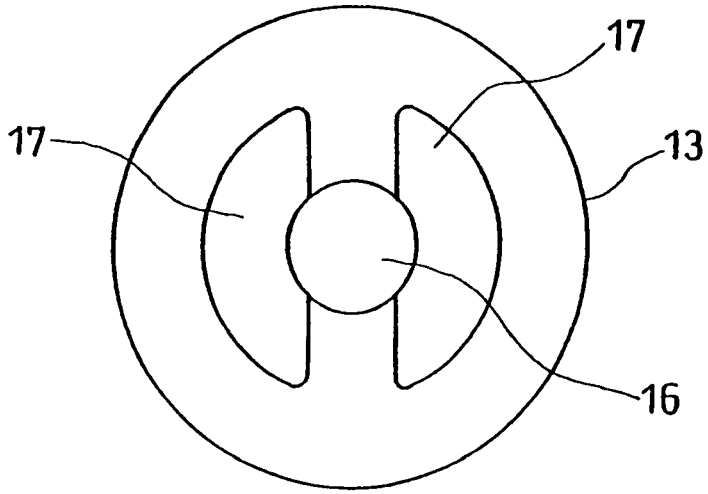
FIG. 4 is a back view showing a female die of the porthole die used in the present invention.
Figure 5:
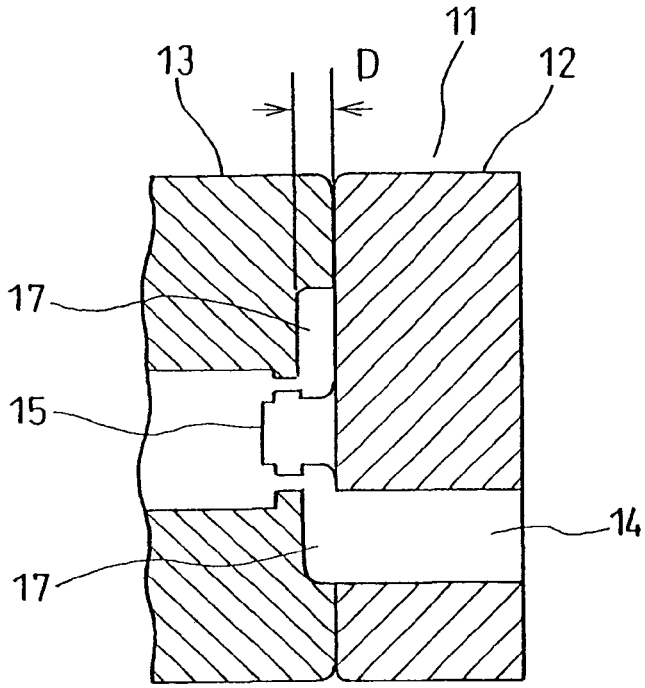
FIG. 5 is a vertical cross-sectional view showing the porthole die when coupling the male die shown in FIG. 3 and the female die shown in FIG. 4.
Figure 6:
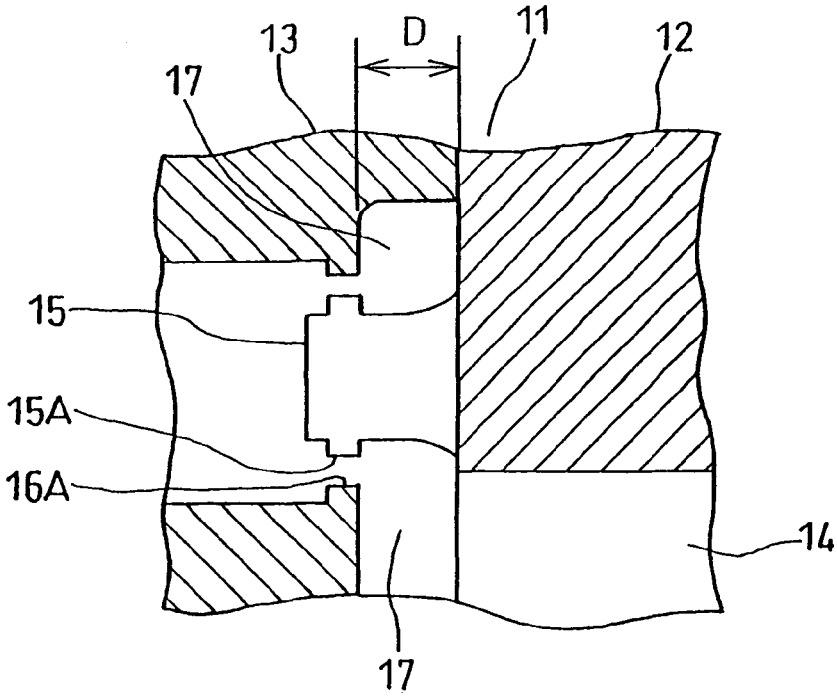
FIG. 6 is an enlarged view of a forming section of the porthole die shown in FIG. 5.

In the extrusion method according to the present invention, a hollow product is extruded as described below. An aluminum alloy having a specific composition is cast into a billet by semicontinuous casting, and hot-extruded into a hollow product by using a porthole die or a bridge die. FIGS. 3 and 4 show a configuration of a porthole die. FIG. 3 is a front view of a male die 12 viewed from a mandrel 15. FIG. 4 is a back view of a female die 13 provided with a die section 16 which houses the mandrel 15. FIG. 5 is a vertical cross-sectional view of a porthole die 11 formed by coupling the male die 12 and the female die 13. FIG. 6 is an enlarged view of a forming section shown in FIG. 5.

The porthole die 11 includes the male die 12 provided with a plurality of port sections 14 and the mandrel 15, and the female die 13 provided with the die section 16, which are coupled together as shown in FIG. 5. A billet pushed by an extrusion stem (not shown) enters the port sections 14 of the male die 12 in divided flows which then rejoin again in a weld chamber 17 while encircling the mandrel 15 in the weld chamber 17. When the billet exits from the weld chamber 17, the billet is formed by a bearing section 15A of the mandrel 15 on the inner surface and by a bearing section 16A of the die section 16 on the outer surface to obtain a hollow product. A bridge die basically has a configuration similar to that of the porthole die except that the structure of the male die is modified taking into consideration the metal flow in the die, extrusion pressure, extrusion workability, and the like.

In this case, the aluminum alloy (metal) after entering and exiting the port sections 14 moves into the weld chamber 17 where the aluminum alloy also flows around the back of bridge sections 18 located between the two port sections 14 to rejoin. It is observed here that the flow speed of the metal in the non-joining section, where the metal flows from one port section 14 directly out to the die section 16 without engaging in the joining action with the metal flow from another port section 14, is greater than the flow speed of the metal in the joining section, where the metal that exited from one port section 14 flows around the back of the bridge section 18 and engages in the welding action with the metal flow from another port section 14, thereby resulting in difference in the metal flow speeds inside the chamber 17. It should be noted that, while FIGS. 3 and 4 illustrate the porthole die having two port sections and two bridge sections, the above-mentioned observation applies equally to a porthole die having three or more port sections and three or more bridge sections.

As a result of extensive experiments and investigations conducted on the relationship between the difference in the metal flow speeds inside the die and the characteristics of the hollow extruded product, the inventors have found that extrusion cracking and growth of coarse grain structure at the joints are caused by the above-described difference in metal flow speeds, and that it is essential to perform extrusion while limiting the ratio of the metal flow speed in the non-joining section to the metal flow speed in the joining section of the chamber 17 to 1.5 or less (i.e. (flow speed in non-joining section)/(flow speed in joining section)≦1.5) in order to prevent these problems. Maintaining the ratio of metal flow speeds within the above limits ensures that the cross-sectional structure of the resulting hollow extruded product has a recrystallization texture with a grain size of 500 μm or less so that a hollow extruded product exhibiting excellent strength, corrosion resistance, and secondary workability is obtained.

Figure 7:
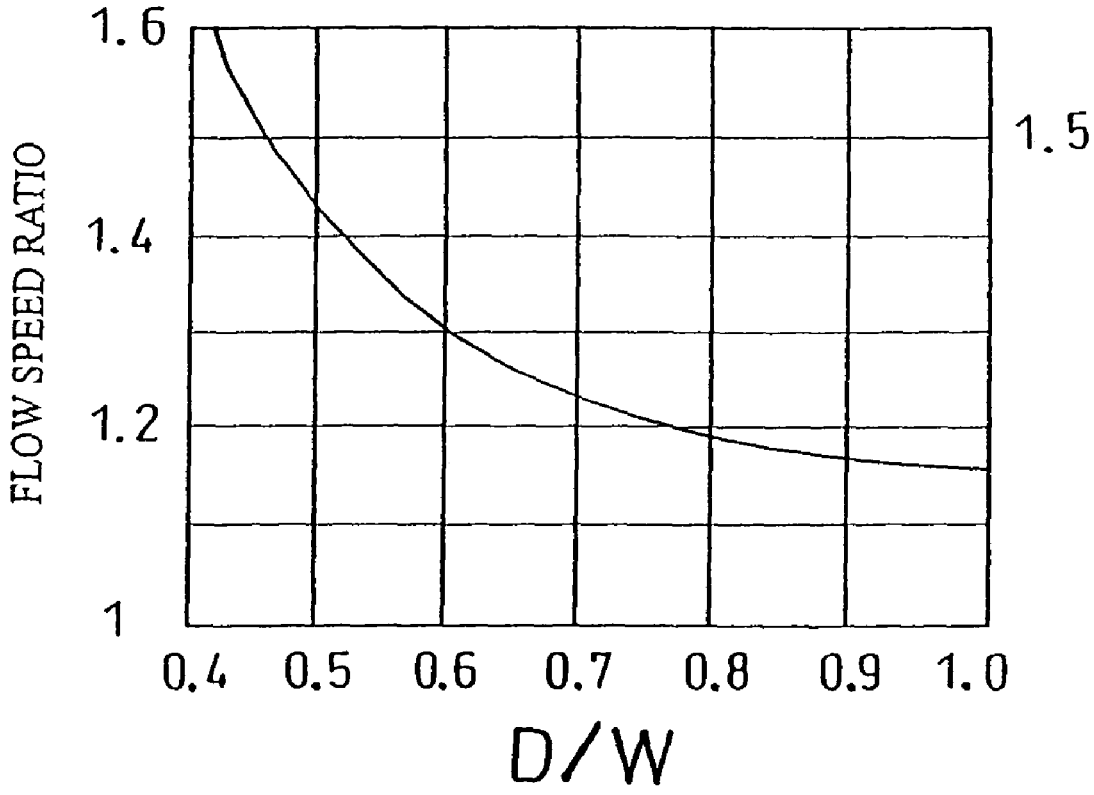
FIG. 7 is a graph showing the relationship between the ratio of a chamber depth D to a bridge width W of the porthole die and the metal flow speed ratio in the die.

In order to perform extrusion while limiting the ratio of the metal flow speed in the non-joining section to the metal flow speed in the joining section of the chamber 17 to 1.5 or less, a porthole die designed in such a way that the ratio of the chamber depth D (FIGS. 5 and 6) to the bridge width W (FIG. 3) is appropriately adjusted is used, for example. FIG. 7 shows an example of the relationship between the D/W ratio and the ratio of the flow speed in the non-joining section to the flow speed in the joining section.

The cross-sectional structure of the extruded product has a recrystallized structure with a grain size of 500 μm or less by combining the above-described alloy composition and manufacturing conditions so that an aluminum alloy extruded product exhibiting excellent strength and corrosion resistance and showing excellent quality in secondary working such as bending or machining is obtained.

EXAMPLES

The present invention is described below based on comparison between examples and comparative examples. However, the following examples merely illustrate one embodiment of the present invention. The present invention is not limited to the following examples.

Example 1

An aluminum alloy having a composition shown in Table 1 was cast by semicontinuous casting to prepare a billet with a diameter of 100 mm. The billet was homogenized at 525° C. for eight hours to prepare an extrusion billet.

The extrusion billet was heated to 480° C. and extruded by using a solid die at an extrusion ratio of 27 and an extrusion rate of 3 m/min to obtain a quadrilateral solid extruded product having a thickness of 12 mm and a width of 24 mm. The solid die had a bearing length of 6 mm, and the corners of an orifice were rounded off with a radius of 0.5 mm. A flow guide attached to the die had a quadrilateral guide hole. The distance (A) from the inner circumferential surface of the guide hole to the outer circumferential surface of the orifice was set at 15 mm, and the thickness (B) of the flow guide was set at 15 mm with respect to the billet diameter of 100 mm (B=15% of billet diameter).

The resulting solid extruded product was subjected to a solution heat treatment by heating the solid extruded product to 530° C. at a temperature rise rate of 10° C./sec, and subjected to water quenching within 10 seconds after completion of the solution heat treatment. The quenched product was subjected to artificial aging at 180° C. for 10 hours after three days to obtain T6 temper material. The resulting T6 material was used as a specimen and subjected to (1) grain size measurement in the cross section perpendicular to the extrusion direction, (2) tensile test, and (3) intergranular corrosion test according to the following methods to evaluate the properties of the material. The evaluation results are shown in Table 2.

(1) Grain size measurement: The minor axis of each grain in the cross section of the extruded product perpendicular to the extrusion direction was measured by using an optical microscope, and the mean value was calculated.

(2) Tensile test: The tensile strength (UTS), yield strength (YS), and elongation at break (δ) of each specimen were measured in accordance with JIS Z 2241.

(3) Intergranular corrosion test: 57 g of sodium chloride (NaCl) and 10 ml of 30% hydrogen peroxide ($H_2O_2$) were dissolved in distilled water to prepare a 1-liter test solution. The specimen was immersed in the test solution at 30° C. for six hours to measure the corrosion weight loss. A specimen with a corrosion weight loss of less than 1.0% was judged to have good corrosion resistance.

As the secondary working quality evaluation method, the T6 material was subjected to 90° bending, and the surface properties of the outer side of the bent section was observed with the naked eye. A specimen in which a surface defect was not observed was evaluated as "Good", and a specimen in which a surface defect was observed was evaluated as "Bad".

TABLE 1

| Alloy | Composition (mass %) | | | | | |
|---|---|---|---|---|---|---|
| | Si | Mg | Cu | Mn | Cr | Others |
| A | 0.8 | 1.0 | 1.7 | <0.01 | 0.15 | — |
| B | 0.8 | 1.0 | 1.7 | 0.05 | 0.15 | — |
| C | 0.8 | 1.0 | 1.7 | <0.01 | 0.04 | — |
| D | 0.8 | 1.0 | 1.7 | <0.01 | 0.35 | — |
| E | 0.8 | 1.0 | 1.7 | <0.01 | 0.15 | Zn: 0.1 |
| F | 0.8 | 1.0 | 1.7 | <0.01 | 0.15 | V: 0.1 |
| G | 0.8 | 1.0 | 1.7 | <0.01 | 0.15 | Zr: 0.1 |
| H | 1.2 | 1.3 | 1.4 | <0.01 | 0.15 | — |
| I | 0.7 | 1.1 | 2.1 | <0.01 | 0.15 | — |
| J | 0.6 | 0.8 | 1.6 | <0.01 | 0.15 | — |
| K | 0.9 | 0.8 | 1.3 | <0.01 | 0.15 | — |
| L | 1.0 | 1.1 | 1.9 | <0.01 | 0.15 | — |
| M | 0.7 | 0.9 | 1.4 | <0.01 | 0.15 | — |
| N | 0.7 | 1.1 | 2.0 | <0.01 | 0.15 | — |

TABLE 2

| Specimen | Alloy | Grain size (μm) | Tensile strength (MPa) | Yield strength (MPa) | Elongation (□) | Corrosion weight loss (□) |
|---|---|---|---|---|---|---|
| 1 | A | 250 | 415 | 380 | 13.0 | 0.3 |
| 2 | B | 200 | 420 | 385 | 12.0 | 0.4 |
| 3 | C | 450 | 400 | 365 | 11.0 | 0.7 |
| 4 | D | 350 | 415 | 378 | 12.0 | 0.7 |
| 5 | E | 300 | 419 | 383 | 14.0 | 0.4 |
| 6 | F | 250 | 412 | 378 | 12.0 | 0.3 |
| 7 | G | 450 | 395 | 372 | 10.5 | 0.8 |
| 8 | H | 250 | 410 | 387 | 12.0 | 0.7 |
| 9 | I | 300 | 420 | 390 | 11.5 | 0.6 |
| 10 | J | 200 | 400 | 352 | 14.0 | 0.4 |
| 11 | K | 150 | 395 | 345 | 15.5 | 0.3 |
| 12 | L | 250 | 425 | 390 | 14.5 | 0.6 |
| 13 | M | 250 | 395 | 355 | 15.5 | 0.4 |
| 14 | N | 250 | 415 | 378 | 14.0 | 0.3 |

As shown in Table 2, specimens No. 1 to No. 14 according to the present invention exhibited excellent strength and corrosion resistance.

Comparative Example 1

An aluminum alloy having a composition shown in Table 3 was cast by semicontinuous casting to prepare a billet with a diameter of 100 mm. The billet was treated in the same manner as in Example 1 to prepare an extrusion billet. The extrusion billet was heated to 480° C. and extruded into a quadrilateral solid extruded product by using the solid die and the flow guide used in Example 1 under the same conditions as in Example 1. The extruded solid product was heat treated in the same manner as in Example 1 to obtain T6 temper material. The resulting T6 material was used as a specimen and subjected to (1) grain size measurement in the cross section perpendicular to the extrusion direction, (2) tensile test, and (3) intergranular corrosion test in the same manner as in Example 1 to evaluate the properties of the material. Specimens No. 22 and No. 23 were also subjected to surface property inspection after bending. The results are shown in Table 4. In Tables 3 and 4, values outside the range according to the present invention are underlined.

TABLE 3

| Alloy | Composition (mass□) | | | | | |
|---|---|---|---|---|---|---|
| | Si | Mg | Cu | Mn | Cr | Others |
| O | 1.3 | 1.0 | 1.6 | <0.01 | 0.15 | — |
| P | 0.9 | 1.4 | 1.6 | <0.01 | 0.15 | — |
| Q | 0.7 | 1.1 | 2.2 | <0.01 | 0.15 | — |
| R | 0.5 | 0.8 | 1.7 | <0.01 | 0.15 | — |
| S | 0.8 | 0.7 | 1.5 | <0.01 | 0.15 | — |
| T | 0.9 | 1.1 | 1.2 | <0.01 | 0.15 | — |
| U | 0.8 | 1.0 | 1.7 | 0.06 | 0.15 | — |
| V | 0.8 | 1.0 | 1.7 | <0.01 | 0.03 | — |
| W | 0.8 | 1.0 | 1.7 | <0.01 | 0.40 | — |
| X | 0.6 | 1.1 | 2.0 | <0.01 | 0.15 | — |
| Y | 0.7 | 0.9 | 1.3 | <0.01 | 0.15 | — |
| Z | 1.0 | 1.1 | 2.0 | <0.01 | 0.15 | — |
| AA | 1.0 | 0.9 | 2.0 | <0.01 | 0.15 | — |
| BB | 0.9 | 1.3 | 1.3 | <0.01 | 0.15 | — |

Note:
The alloy X does not satisfy "Mg ≦ 1.7 × Si".
The alloy Y has a value "Si + Mg + Cu" outside the range according to the present invention.
The alloy Z has a value "Si + Mg + Cu" outside the range according to the present invention.
The alloy AA does not satisfy "Cu/2 ≦ Mg".
The alloy BB does not satisfy "Mg ≦ (Cu/2) + 0.6".

TABLE 4

| Specimen | Alloy | Grain size (μm) | Tensile strength (MPa) | Yield strength (MPa) | Elongation (%) | Corrosion weight loss (%) |
|---|---|---|---|---|---|---|
| 15 | O | 250 | 425 | 388 | 13.0 | 1.1 |
| 16 | P | 300 | 430 | 388 | 11.0 | 1.1 |
| 17 | Q | 350 | 433 | 390 | 11.0 | 1.2 |
| 18 | R | 350 | 385 | 345 | 16.5 | 0.4 |
| 19 | S | 300 | 385 | 340 | 16.5 | 0.3 |
| 20 | T | 250 | 383 | 338 | 16.0 | 0.4 |
| 21 | U | 250 | 417 | 388 | 12.0 | 1.2 |
| 22 | V | 450 | 395 | 373 | 11.0 | 1.5 |
| 23 | W | 500 | 405 | 370 | 12.0 | 0.7 |
| 24 | X | 250 | 418 | 380 | 11.5 | 1.1 |
| 25 | Y | 350 | 380 | 335 | 16.0 | 0.3 |
| 26 | Z | 300 | 418 | 388 | 14.0 | 1.1 |
| 27 | AA | 350 | 426 | 390 | 11.0 | 1.3 |
| 28 | BB | 400 | 430 | 386 | 10.0 | 1.1 |

As shown in Table 4, specimens No. 15 to No. 17 exhibited inferior corrosion resistance due to high Si content, high Mg content, and high Cu content, respectively. Specimens No. 18 to No. 20 exhibited insufficient strength due to low Si content, low Mg content, and low Cu content, respectively. A coarse intermetallic compound was formed in a specimen No. 21 due to high Mn content, so that corrosion resistance was decreased. A specimen No. 22 exhibited poor corrosion resistance due to low Cr content. A specimen No. 23 developed a coarse intermetallic compound due high Cr content so that the grains became nonuniform. As a result, a defect was observed in the surface property inspection after bending. Since a specimen No. 24 does not satisfy "Mg %≦1.7×Si %", the specimen No. 24 exhibited inferior corrosion resistance. Specimens No. 25 and No. 26 exhibited inferior strength and inferior corrosion resistance, respectively, since the total content of Si, Mg, and Cu is less than the lower limit or exceeds the upper limit specified according to the present invention. Since a specimen No. 27 does not satisfy "Cu %/2≦Mg %", the specimen No. 27 exhibited inferior corrosion resistance. Since a specimen No. 28 does not satisfy "Mg %≦(Cu %/2)+0.6", the specimen No. 28 exhibited inferior corrosion resistance.

Example 2

The aluminum alloy A having the composition shown in Table 1 was cast by semicontinuous casting to prepare a billet with a diameter of 100 mm. The billet was homogenized at 500° C. and extruded into a quadrilateral solid extruded product (thickness: 12 mm, width: 24 mm) by using a solid die having a bearing length shown in Table 5. The extrusion temperature was 480° C. except for specimen No. 34 (430° C.), and the extrusion rate was 3 m/min.

The solid extruded product was subjected to press quenching or quenching under conditions shown in Table 5, and was heat treated under the same conditions as in Example 1 to obtain T6 temper material. In Table 5, the quenching cooling rate is the average cooling rate from the solution heat treatment temperature to 100° C. A controlled atmosphere furnace was used for the solution heat treatment.

The resulting T6 material was used as a specimen and subjected to (1) grain size measurement in the cross section perpendicular to the extrusion direction, (2) tensile test, (3) intergranular corrosion test, and surface property inspection after bending in the same manner as in Example 1 to evaluate the properties of the material. The evaluation results are shown in Table 6.

Comparative Example 2

The aluminum alloy A having the composition shown in Table 1 was cast by semicontinuous casting to prepare a billet with a diameter of 100 mm. The billet was treated under conditions shown in Table 5, and extruded into a quadrilateral solid extruded product. A solid die with a bearing length of 6 mm was used for specimens No. 29 to No. 37, No. 41, and No. 42. A solid die with a bearing length of 0.4 mm was used for a specimen No. 39. A solid die with a bearing length of 65 mm was used for a specimen No. 40. A flow guide was not provided when extruding the specimens No. 29 to No. 40, and a flow guide was provided when extruding the specimens No. 41 and No. 42.

The solid extruded product was subjected to press quenching or quenching under conditions shown in Table 5, and was heat treated under the same conditions as in Example 1 to obtain T6 temper material. In Table 5, the press quenching cooling rate is the average cooling rate from the material temperature before water cooling to 100° C., and the quenching cooling rate is the average cooling rate from the solution heat treatment temperature to 100° C. A controlled atmosphere furnace was used for the solution heat treatment.

The resulting T6 material was used as a specimen and subjected to (1) grain size measurement in the cross section perpendicular to the extrusion direction, (2) tensile test, and (3) intergranular corrosion test in the same manner as in Example 1 to evaluate the properties of the material. The evaluation results are shown in Table 6. In Table 5, values outside the range according to the present invention are underlined.

TABLE 5

| | Die | Press quenching | | Quenching | | |
|---|---|---|---|---|---|---|
| Specimen | bearing length (mm) | Material temperature before water cooling (° C.) | Cooling rate (° C./sec) | Temperature rise rate (° C./sec) | Temperature (° C.) | Cooling rate (° C./sec) |
| 29 | 6 | 480 | 100 | — | — | — |
| 30 | 6 | 480 | 50 | — | — | — |
| 31 | 6 | 480 | 10 | — | — | — |
| 32 | 6 | 480 | 5 | — | — | — |
| 33 | 6 | Without water cooling | 0.1 | 10 | 530 | 100 |
| 34 | 6 | Without water cooling | 0.1 | 10 | 530 | 100 |
| 35 | 6 | Without water cooling | 0.1 | 3 | 530 | 100 |
| 36 | 6 | Without water cooling | 0.1 | 5 | 530 | 10 |
| 37 | 6 | Without water cooling | 0.1 | 10 | 530 | 5 |
| 38 | 50 | 480 | 100 | — | — | — |
| 39 | 0.4 | 480 | 100 | — | — | — |
| 40 | 65 | 480 | 100 | — | — | — |
| 41 | 6 | 480 | 100 | — | — | — |
| 42 | 6 | 480 | 100 | — | — | — |

Note:
Specimen No. 41: continuous extrusion, A = 4 mm
Specimen No. 42: flow guide is provided, A = 9 mm

TABLE 6

| Specimen | Grain size (μm) | Tensile strength (MPa) | Yield strength (MPa) | Elongation (□) | Corrosion weight loss (□) | Surface properties after bending |
|---|---|---|---|---|---|---|
| 29 | 200 | 415 | 380 | 13.0 | 0.3 | Good |
| 30 | 210 | 411 | 374 | 13.5 | 0.4 | Good |
| 31 | 220 | 404 | 373 | 14.0 | 0.5 | Good |
| 32 | 220 | 376 | 334 | 15.5 | 0.6 | — |

TABLE 6-continued

| Specimen | Grain size (μm) | Tensile strength (MPa) | Yield strength (MPa) | Elongation (□) | Corrosion weight loss (□) | Surface properties after bending |
|---|---|---|---|---|---|---|
| 33 | 200 | 418 | 382 | 13.0 | 0.4 | Good |
| 34 | 400 | 370 | 320 | 14.5 | 0.9 | — |
| 35 | 510 | 393 | 360 | 8.0 | 0.9 | Bad |
| 36 | 350 | 405 | 374 | 11.0 | 0.7 | Good |
| 37 | 220 | 370 | 339 | 13.5 | 0.6 | — |
| 38 | 480 | 398 | 365 | 10.0 | 0.9 | Good |
| 39 | — | — | — | — | — | — |
| 40 | 700 | 390 | 359 | 6.0 | 1.5 | Bad |
| 41 | 520 | 392 | 360 | 10.0 | 0.9 | Bad |
| 42 | 400 | 402 | 370 | 10.5 | 0.8 | Good |

As shown in Table 6, the specimens No. 29 to No. 31, No. 33, No. 36, and No. 38 according to the manufacturing conditions of the present invention demonstrated excellent strength and corrosion resistance. On the other hand, the specimen No. 32 exhibited inferior strength due to low cooling rate during press quenching. The specimen No. 34 exhibited inferior strength, since dissolution of the elements added was insufficient due to low extrusion temperature. The specimen No. 35 exhibited low elongation since the grains were grown due to low temperature rise rate during quenching, so that the surface properties after bending became poor. The specimen No. 37 exhibited inferior strength due to low cooling rate during quenching.

In the specimen No. 39, since the bearing length of the solid die was small, the specimen No. 39 could not be extruded due to breakage of the bearing. In the specimen No. 40, since the bearing length of the solid die was too long, the extrusion temperature was increased so that coarse recrystallized grains were formed. As a result, the specimen No. 40 exhibited inferior elongation and corrosion resistance. Moreover, the surface properties after bending were poor.

The following problems occurred when providing the flow guide for continuous extrusion of the billets. Specifically, since the distance A between the inner circumferential surface of the guide hole in the flow guide provided at the front of the solid die and the outer circumferential surface of the orifice in the solid die was small, the extrusion temperature was increased when extruding the specimen No. 41, so that coarse recrystallized grains were formed. As a result, the surface properties after bending became poor. On the other hand, fine recrystallized grains were formed in the specimen No. 42, for which the distance A was 5 mm or more, so that the specimen No. 42 exhibited excellent strength, elongation, corrosion resistance, and surface properties after bending.

Example 3

An aluminum alloy having a composition shown in Table 1 was cast by semicontinuous casting to prepare a billet with a diameter of 200 mm. The billet was homogenized at 525° C. for eight hours to prepare an extrusion billet. The extrusion billet was extruded (extrusion ratio: 20) into a tubular product having an outer diameter of 30 mm and an inner diameter of 20 mm at an extrusion temperature of 480° C. and an extrusion rate of 3 m/min by using a porthole die in which the ratio of the chamber depth D to the bridge width W was 0.5 to 0.6. The ratio of the flow speed of the aluminum alloy in the non-joining section of the die to the flow speed of the aluminum alloy in the joining section was 1.3 to 1.4.

The resulting tubular extruded product was subjected to a solution heat treatment by heating the extruded product to 530° C. at a temperature rise rate of 10° C./sec, and subjected to water quenching within 10 seconds after completion of the solution heat treatment. The quenched product was then subjected to artificial aging (tempering) at 180° C. for 10 hours to obtain T6 temper material. The resulting T6 material was used as a specimen and subjected to (1) grain size measurement in the cross section perpendicular to the extrusion direction, (2) tensile test, and (3) intergranular corrosion test in the same manner as in Example 1 to evaluate the properties of the material. The evaluation results are shown in Table 7.

TABLE 7

| Specimen | Alloy | Grain size (μm) | Tensile strength (MPa) | Yield strength (MPa) | Elongation (%) | Corrosion weight loss (%) |
|---|---|---|---|---|---|---|
| 43 | A | 200 | 415 | 380 | 13.0 | 0.3 |
| 44 | B | 220 | 418 | 385 | 12.0 | 0.5 |
| 45 | C | 450 | 405 | 370 | 10.0 | 0.8 |
| 46 | D | 410 | 410 | 375 | 11.0 | 0.7 |
| 47 | E | 210 | 417 | 382 | 13.5 | 0.3 |
| 48 | F | 200 | 415 | 380 | 13.0 | 0.3 |
| 49 | G | 440 | 398 | 373 | 10.5 | 0.8 |
| 50 | H | 200 | 420 | 390 | 13.0 | 0.7 |
| 51 | I | 250 | 425 | 395 | 12.5 | 0.7 |
| 52 | J | 160 | 400 | 350 | 15.0 | 0.3 |
| 53 | K | 150 | 390 | 345 | 16.0 | 0.3 |
| 54 | L | 220 | 420 | 385 | 13.5 | 0.7 |
| 55 | M | 230 | 390 | 350 | 15.5 | 0.3 |
| 56 | N | 200 | 420 | 380 | 13.5 | 0.3 |

As shown in Table 7, specimens No. 43 to No. 56 according to the present invention exhibited excellent strength and corrosion resistance.

Comparative Example 3

An aluminum alloy having a composition shown in Table 3 was cast by semicontinuous casting to prepare a billet with a diameter of 100 mm. The billet was treated in the same manner as in Example 3 to prepare an extrusion billet. The extrusion billet was heated to 480° C. and extruded into a tubular extruded product by using the porthole die used in Example 3 under the same conditions as in Example 1. The tubular extruded product was heat treated in the same manner as in Example 3 to obtain T6 temper material. The resulting T6 material was used as a specimen and subjected to (1) grain size measurement in the cross section perpendicular to the extrusion direction, (2) tensile test, and (3) intergranular corrosion test in the same manner as in Example 1 to evaluate the properties of the material. Specimens No. 64 and No. 65 were also subjected to surface properties inspection after bending. The test results are shown in Table 8. In Table 8, values outside the range according to the present invention are underlined.

TABLE 8

| Specimen | Alloy | Grain size (μm) | Tensile strength (MPa) | Yield strength (MPa) | Elongation (%) | Corrosion weight loss (%) |
|---|---|---|---|---|---|---|
| 57 | O | 250 | 420 | 385 | 13.5 | 1.1 |
| 58 | P | 330 | 425 | 385 | 11.0 | 1.2 |
| 59 | Q | 340 | 430 | 385 | 10.0 | 1.3 |
| 60 | R | 310 | 385 | 340 | 17.0 | 0.3 |
| 61 | S | 300 | 385 | 340 | 17.0 | 0.3 |
| 62 | T | 260 | 385 | 340 | 17.0 | 0.3 |
| 63 | U | 210 | 420 | 388 | 11.5 | 1.1 |

TABLE 8-continued

| Specimen | Alloy | Grain size (μm) | Tensile strength (MPa) | Yield strength (MPa) | Elongation (%) | Corrosion weight loss (%) |
|---|---|---|---|---|---|---|
| 64 | V | 440 | 395 | 370 | 10.0 | 1.5 |
| 65 | W | 460 | 400 | 375 | 11.0 | 0.8 |
| 66 | X | 190 | 420 | 380 | 13.5 | 1.1 |
| 67 | Y | 320 | 385 | 340 | 17.0 | 0.3 |
| 68 | Z | 250 | 420 | 385 | 13.5 | 1.2 |
| 69 | AA | 340 | 430 | 385 | 10.0 | 1.3 |
| 70 | BB | 350 | 430 | 385 | 10.0 | 1.2 |

As shown in Table 8, specimens No. 57 to No. 59 exhibited inferior corrosion resistance due to high Si content, high Mg content, and high Cu content, respectively. Specimens No. 60 to No. 62 exhibited insufficient strength due to low Si content, low Mg content, and low Cu content, respectively. A coarse intermetallic compound was formed in a specimen No. 63 due to high Mn content, so that corrosion resistance was decreased. A specimen No. 64 exhibited poor corrosion resistance due to low Cr content. A specimen No. 65 developed a coarse intermetallic compound due high Cr content so that the grains became nonuniform. As a result, the surface properties after bending were poor. Since a specimen No. 66 does not satisfy "Mg %≦1.7×Si %", the specimen No. 66 exhibited inferior corrosion resistance. Specimens No. 67 and No. 68 exhibited inferior strength and inferior corrosion resistance, respectively, since the total content of Si, Mg, and Cu is less than the lower limit or exceeds the upper limit specified according to the present invention. Since a specimen No. 69 does not satisfy "Cu %/2≦Mg %", the specimen No. 69 exhibited inferior corrosion resistance. Since a specimen No. 70 does not satisfy "Mg %≦(Cu %/2)+0.6", the specimen No. 70 exhibited inferior corrosion resistance.

Example 4

The aluminum alloy A having the composition shown in Table 1 was cast by semi-continuous casting to prepare billets with a diameter of 200 mm. The billet was homogenized at 500° C. and extruded into a tubular extruded product at an extrusion temperature of 480° C. (430° C. for specimen No. 76) and an extrusion rate of 3 m/min. As the extrusion die, the porthole die with the flow speed ratio listed in Table 9 was used.

The extruded tubular product was subjected to press quenching or quenching under conditions shown in Table 9, and was heat treated under the same conditions as in Example 3 to obtain T6 temper material. In Table 9, the press quenching cooling rate is the average cooling rate from the material temperature before water cooling to 100° C., and the quenching cooling rate is the average cooling rate from the heat solution treatment temperature to 100° C. A controlled atmosphere furnace was used for the solution heat treatment.

The resulting T6 material was used as a specimen and subjected to (1) grain size measurement in the cross section perpendicular to the extrusion direction, (2) tensile test, and (3) intergranular corrosion test in the same manner as in Example 3 to evaluate the properties of the material. The specimen was also subjected to surface property inspection after bending. The results are shown in Table 10.

Comparative Example 4

The aluminum alloy A having the composition shown in Table 1 was cast by semicontinuous casting to prepare a billet with a diameter of 100 mm. The billet was homogenized at 500° C. and extruded into a tubular extruded product at an extrusion temperature of 480° C. (430° C. for specimen No. 76) and an extrusion rate of 3 m/min. Specimens No. 71 to No. 79 were extruded by using the porthole die with the flow speed ratio listed in Table 9. A specimen No. 80 was extruded by using a porthole die in which the ratio (W/D) of the weld chamber depth D to the bridge width W was 0.43.

The tubular extruded product was subjected to press quenching or quenching under conditions shown in Table 9, and was heat treated tempered under the same conditions as in Example 3 to obtain T6 temper material.

The resulting T6 material was used as a specimen and subjected to (1) grain size measurement in the cross section perpendicular to the extrusion direction, (2) tensile test, and (3) intergranular corrosion test in the same manner as in Example 1 to evaluate the properties of the material. The evaluation results are shown in Table 10. In Tables 9 and 10, values outside the range according to the present invention are underlined.

TABLE 9

| | Metal | Press quenching | | Quenching | | |
|---|---|---|---|---|---|---|
| Specimen | flow speed ratio in a die (mm) | Material temperature before water cooling (° C.) | Cooling rate (° C./sec) | Temperature rise rate (° C./sec) | Temperature (° C.) | Cooling rate (° C./sec) |
| 71 | 1.2 | 480 | 100 | — | — | — |
| 72 | 1.3 | 480 | 50 | — | — | — |
| 73 | 1.2 | 480 | 10 | — | — | — |
| 74 | 1.3 | 480 | 5 | — | — | — |
| 75 | 1.2 | Without water cooling | 0.1 | 10 | 530 | 100 |
| 76 | 1.3 | Without water cooling | 0.1 | 10 | 530 | 100 |
| 77 | 1.3 | Without water cooling | 0.1 | 3 | 530 | 100 |
| 78 | 1.2 | Without water cooling | 0.1 | 5 | 530 | 10 |
| 79 | 1.3 | Without water cooling | 0.1 | 10 | 530 | 5 |
| 80 | 1.6 | 480 | 100 | — | — | — |

TABLE 10

| Specimen | Grain size (μm) | Tensile strength (MPa) | Yield strength (MPa) | Elongation (%) | Corrosion weight loss (%) | Surface properties after bending |
|---|---|---|---|---|---|---|
| 71 | 200 | 415 | 380 | 13.0 | 0.3 | Good |
| 72 | 250 | 409 | 372 | 12.0 | 0.4 | Good |
| 73 | 200 | 406 | 375 | 14.0 | 0.5 | Good |
| 74 | 220 | 374 | 337 | 15.0 | 0.6 | — |
| 75 | 200 | 420 | 385 | 13.0 | 0.4 | Good |
| 76 | 390 | 372 | 321 | 14.5 | 0.9 | — |
| 77 | 510 | 395 | 362 | 8.5 | 0.9 | Bad |
| 78 | 340 | 408 | 376 | 11.5 | 0.7 | Good |
| 79 | 200 | 380 | 339 | 13.0 | 0.6 | — |
| 80 | 520 | 390 | 360 | 10.0 | 0.9 | Bad |

As shown in Table 10, specimens No. 71 to No. 73, No. 75, and No. 78 according to the manufacturing conditions of the present invention demonstrated excellent strength and corrosion resistance. On the other hand, a specimen No. 74 exhibited inferior strength due to low cooling rate during press quenching. A specimen No. 76 exhibited inferior strength, since dissolution of the elements added was insufficient due to low extrusion temperature. A specimen No. 77 exhibited low elongation since the grains were grown due to low temperature rise rate during quenching. Moreover, the surface properties after bending were poor. A specimen No. 79 exhibited inferior strength due to low cooling rate during quenching. Since a specimen No. 80 was extruded with a die having a high flow speed ratio, the recrystallized grains were grown along with an increase in the extrusion temperature, thereby resulting in poor surface properties after bending.

Industrial Applicability

According to the present invention, a high-strength aluminum alloy extruded product exhibiting excellent corrosion resistance and secondary workability and a method of manufacturing the same can be provided. The aluminum alloy extruded product according to the present invention is suitably used as a structural material for transportation equipment, such as automobiles, railroad vehicles, and aircrafts, instead of an iron structural material.

What is claimed is:

1. A method of manufacturing an aluminum alloy extruded product, comprising the steps of: extruding a billet of an aluminum alloy having a composition comprising, in mass %, 0.6-1.2% Si, 0.8-1.3% Mg, 1.3-2.1% Cu, 0.04-0.35% Cr and no more than than 0.05% Mn as an impurity, with the balance being aluminum and unavoidable impurities and the following (1)-(4) relationships being satisfied, $$3\% \leqq Si\ \% + Mg\ \% + Cu\ \% \leqq 4\% \quad (1)$$

$$Mg\ \% \leqq 1.7 \times Si\ \% \quad (2)$$

$$Mg\ \% + Si\ \% \leqq 2.7\% \quad (3)$$

$$Cu\ \%/2 \leqq Mg\ \% \leqq (Cu\ \%/2) + 0.6\% \quad (4)$$

into a hollow product by using a porthole die having a ratio, D/W, of chamber depth D to bridge width W of 0.5 or more while setting a ratio of a flow speed of the aluminum alloy in a non-joining section to a flow speed of the aluminum alloy in a joining section in a chamber, where the billet reunites after entering a port section of the die in divided flows and subsequently encircling a mandrel, at 1.5 or less, to obtain a hollow extruded product having a cross-sectional structure which has a recrystallization microstructure with a grain size of no more than 500 μm and, in which, a surface defect is not observed after the hollow extruded product is subjected to a solution heat treatment by heating to 530° C. at a temperature rise rate of 10° C./sec, water quenching within 10 seconds after completion of the solution heat treatment, aged at 180° C. for 10 hours and subjected to 90° bending.

2. The method of claim l, additionally comprising the steps of homogenizing the billet at a temperature equal to or higher than 500° C. and lower than the melting point of the aluminum alloy and heating the homogenized billet to a temperature equal to or higher than 470° C. and lower than the melting point of the aluminum alloy and extruding the billet.

3. The method of claim l, additionally comprising a quenching step of maintaining a surface temperature of the extruded product immediately after extrusion at 450° C. or higher and then cooling the extruded product to 100° C. or lower at a cooling rate of 10° C./sec or more or subjecting the extruded product to a solution heat treatment at a temperature of 480 to 580° C. at a temperature rise rate of 5° C./sec or more and then a quenching step of cooling the extruded product to 100° C. or lower at a cooling rate of 10° C./sec or more and a tempering step of heating the extruded product at 170 to 200° C. for 2 to 24 hours.

4. The method of claim 2, additionally comprising a quenching step of maintaining a surface temperature of the extruded product immediately after extrusion at 450° C. or higher and then cooling the extruded product to 100° C. or lower at a cooling rate of 10° C./sec or more or subjecting the extruded product to a solution heat treatment at a temperature of 480 to 580° C. at a temperature rise rate of 5° C./sec or more and then a quenching step of cooling the extruded product to 100° C. or lower at a cooling rate of 10° C./sec or more and a tempering step of heating the extruded product at 170 to 200° C. for 2 to 24 hours.

* * * * *